United States Patent [19]

Kusano et al.

[11] Patent Number: 4,609,846

[45] Date of Patent: Sep. 2, 1986

[54] IMAGE PICK-UP TUBE HAVING COLLECTOR AND BALANCE ELECTRODES

[75] Inventors: Chushirou Kusano, Tokorozawa; Sachio Ishioka; Yasuharu Shimomoto, both of Tokyo; Yoshinori Imamura, Kanagawa; Hirofumi Ogawa, Hachioji, all of Japan

[73] Assignee: Hitachi, Ltd., Tokyo, Japan

[21] Appl. No.: 652,459

[22] Filed: Sep. 20, 1984

[30] Foreign Application Priority Data

Sep. 21, 1983 [JP] Japan ..... 58-172934

[51] Int. Cl.[4] ..... H01J 29/45; H01J 29/82

[52] U.S. Cl. ..... 313/384; 313/387; 313/390; 313/106

[58] Field of Search ..... 313/384, 386, 390, 106, 313/387

[56] References Cited

U.S. PATENT DOCUMENTS 3,857,037 12/1974 Tomii et al. ..... 313/384 X 4,255,686 3/1981 Maruyama et al. ..... 313/386 X

*Primary Examiner*—Leo H. Boudreau

*Assistant Examiner*—K. Wieder

*Attorney, Agent, or Firm*—Antonelli, Terry & Wands

[57] ABSTRACT

An image pick-up tube has a photoelectric conversion target including a transparent substrate, and a transparent electrode and a photoconductive layer formed on the transparent substrate. An electron beam is scanned on the photoelectric conversion target. A first electrode is formed on a beam scanning surface of the photoconductive layer so as to be segmented in stripe or grid with its electrode segments electrically connected to each other. A second electrode is formed on the first electrode through an insulating layer with its electrode segments electrically connected to each other. An insulating layer may be interposed between the first electrode and the photoconductive layer.

19 Claims, 5 Drawing Figures

IMAGE PICK-UP TUBE HAVING COLLECTOR AND BALANCE ELECTRODES

BACKGROUND OF THE INVENTION

This invention relates to a photoconductive image pick-up tube of the type wherein photoelectric conversion signals are read by an electron beam scanned at a high velocity.

In the past, most image pick-up tubes are based on a low velocity electron beam scanning positive charging system (hereinafter referred to as LP system) in which an electron beam is scanned at a low velocity, and therefore have a long lag especially at low illumination and suffer from beam being responsible for tendency to the generation of image distortion and shading.

Incidentally, an expedient to solve the above disadvantages has been known as a high velocity electron beam scanning negative charging system (hereinafter referred to as HN system) as disclosed in Japanese patent application Laid-Open No. 54-44487 laid open on 1979, for example. FIG. 1 is useful in explaining the operational principle of the HN system. According to the HN system, a transparent electrode 2 is applied with a positive voltage relative to a cathode electrode 9 so that a target of the image pick-up tube possesses a secondary electron emission yield $\delta$ which is greater than 1 (one). When an electron beam 6 is scanned at a high velocity under this condition, a secondary electron beam 7 is emitted from the surface of the target (especially a photoconductive layer 3) and as a result, a potential at the target surface is brought into equilibrium with a potential at a focusing collector electrode 8 to become positive relative to the transparent electrode 2. Light passing through a transparent substrate 1 and the transparent electrode 2 is absorbed by the photoconductive layer 3 to generate electron-hole pairs of which electrons are drawn in the direction of scanning surface to cause the surface potential to drop toward negative. This potential drop is derived as a signal. In FIG. 1, reference numerals 10 and 11 denote a load resistor and a target voltage source, respectively.

This HN system image pick-up tube is superior to the conventional LP system in that the capacitive lag is reduced, that the resolution at the corner is high, and that the image distortion is reduced. In the proposed HN system, however, the potential difference between the focusing collector electrode 8 and the scanning surface of the target is almost zeroed with the result that the secondary electron emitted from the target is partly scattered toward the target surface to redistribute thereon, giving rise to the generation of spurious signals and consequent impairment of high quality image.

A countermeasure for elimination of the spurious signals has been proposed (U.S. patent application Ser. No. 547,962 filed on Nov. 2, 1983, now U.S. Pat. No. 4,556,817) wherein an electrode for defining an additional potential is disposed near the target to cause the secondary electron to be collected forcibly by the collector electrode 8, and the electrode for defining the additional potential is materialized by a metallic mesh-like electrode directly applied to the beam scanning surface of the target or by a stripe-like balance electrode formed on the scanning surface. This proposal on the one hand succeeds in suppressing the redistribution but on the other hand suffers from degradation of characteristics including degradation of resolution and increase in lag. Accordingly, the advent of an image pick-up tube has been desired which can be free from adverse secondary effect so as to eliminate the spurious signal.

SUMMARY OF THE INVENTION

An object of this invention is to provide an image pick-up tube which can be free from the degradation of resolution and increase in lag so as to eliminate the spurious signal attributable to the redistribution of secondary electron.

According to this invention, a balance electrode in the form of a double layer structure is formed on the beam scanning surface of the target so as to eliminate the spurious signal.

The inventors of the present application have studied the conventional HN system thoroughly to find that the problems set forth previously are due to a potential gradient in the photoconductive layer which is created by the potential difference between the balance electrode and the surface of photoconductive layer scanned with the electron beam.

The effect of preventing the redistribution of secondary electron will however be lost if potential at the balance electrode is made equal to that at the beam scanning surface.

According to the invention, a set of electrodes in the form of a double-layer structure are provided, one lower electrode, termed a first electrode, close to the target is maintained at a potential which is equal to that at the beam scanning surface, and the other upper electrode termed a second electrode is maintained at a potential which is lower than that at the collector electrode to meet the prevention of the redistribution of secondary electron as in the conventional system.

DESCRIPTION OF THE PREFERRED EMBODIMENTS

Figure 1:
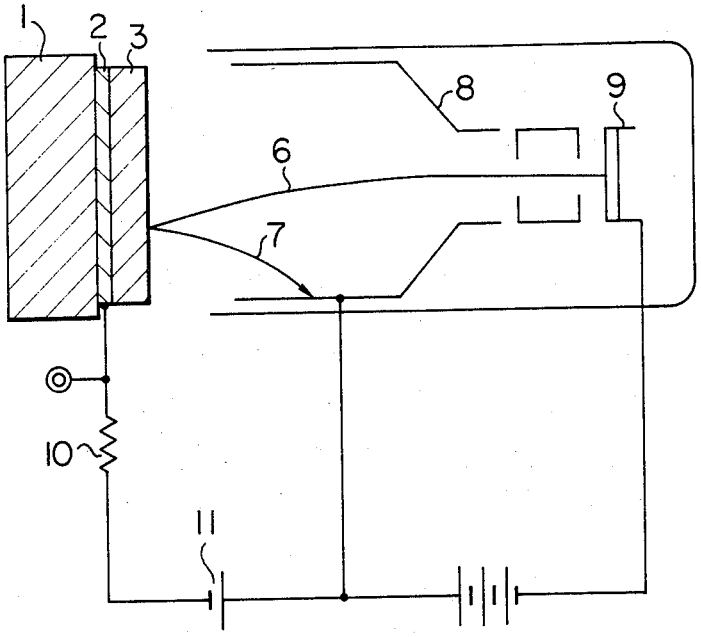
FIG. 1 PRIOR ART
FIG. 1 is a schematic diagram of a prior art HN system image pick-up tube useful in explaining the operation thereof.

A preferred embodiment of an image pick-up tube according to the present invention will now be described with reference to FIG. 2 in which identical parts to those of the prior art image pick-up tube shown in FIG. 1 are denoted by identical reference numerals.

Figure 2:
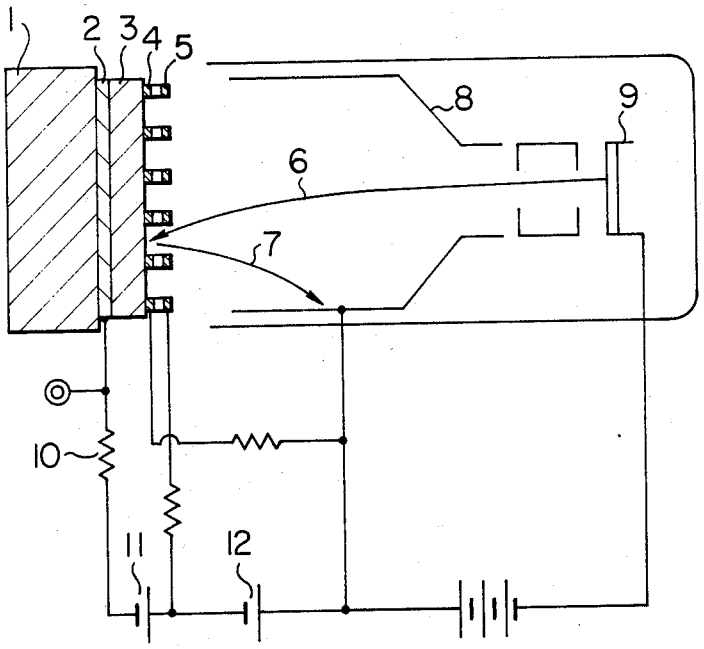
FIG. 2 is a schematic diagram showing an image pick-up tube embodying the invention.

As schematically shown in FIG. 2 especially useful to explain the operational principle of the image pick-up tube of the invention, first and second electrodes 4 and 5 of stripe-like or grid-like segmented form are arranged in such a manner that electrode segments of the first electrode are maintained at the same potential and electrode segments of the second electrode are also maintained at the same potential.

In operation, when a target of the above construction is scanned with an electron beam travelling at a high velocity, a secondary electron emitted from the target is accelerated by an electric field created by a power source 12 connected across the second electrode 5 and the collector electrode 8 and collected by the collector electrode 8, thereby preventing the secondary electron from being redistributed on the target surface to avoid the generation of spurious signals.

The first electrode 4 is effective to prevent the establishment of a potential gradient in the photoconductive layer, thereby ensuring that the degradation of resolution and increase in lag can be prevented to provide excellent image signals.

Figure 3:
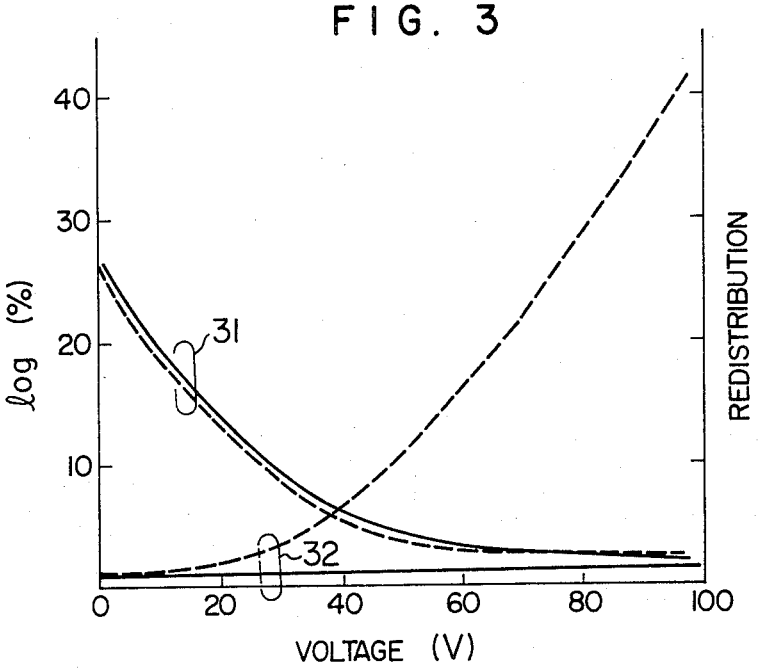
FIG. 3 is a graphical representation for comparison of effects of the invention with those of the prior art system, showing a lag characteristic and a redistribution characteristic according to the image pickup tube of the present invention, as represented by solid line, and those according to the prior art image pick-up tube as represented by dotted line.

Referring to FIG. 3, a redistribution characteristic 31 and a lag characteristic 32 of the FIG. 2 image pick-up tube target according to the present invention, as represent by solid line, are graphically illustrated for comparison with those of the prior art image pick-up tube target as represent by dotted line. In FIG. 3, the abscissa represents the voltage of the power source 11 for the prior art system but for the present invention, the potential difference between the first and second electrodes.

Figure 4:
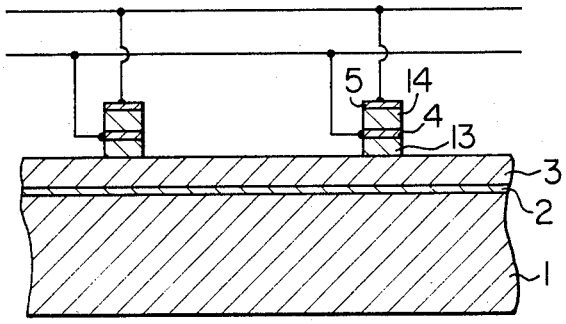
FIG. 4 is a sectional view showing an image pick-up tube target according to an embodiment of the invention.

FIG. 4 shows, in sectional form, a typical example of the target structure according to the invention. A first electrode 4 of a double-layer electrode structure is formed on a stripe-like or grid-like insulating layer 13 which overlies the photoconductive layer 3. A stripe-like or grid-like insulating layer 14 is formed on the first electrode 4, and an upper second electrode 5 is formed on the insulating layer 14 so as to be electrically isolated from the first electrode 4. The thus formed first and second electrodes are led to the outside of the image pick-up tube through conductors which are electrically isolated from each other, and independently applied with voltages.

Figure 5:
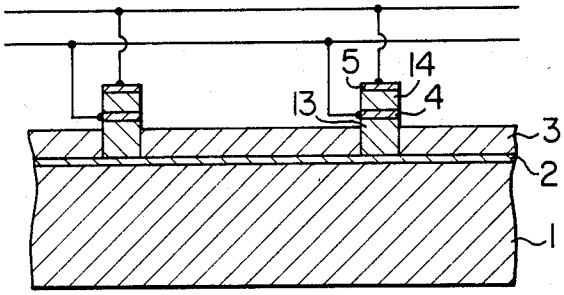
FIG. 5 is a sectional view showing an image pick-up tube target according to another embodiment of the invention.

FIG. 5 shows another example of the target structure. In FIG. 5, a stripe-like or grid-like insulating layer 13 is formed directly on the transparent electrode 2 in registration with a first stripe-like or grid-like electrode 4 so as to electrically isolate the first electrode 4 from the photoconductive layer 3. In other words, the photoconductive layer is partly removed between a double-layer electrode structure of first and second electrodes 4 and 5 and the transparent electrode 2, and the stripe-like or grid-like insulating layer 13 is filled in the voids in the photoconductive layer 3. With the target structure described above, the creation of electron-hole pairs and storage of electric charge at the double-layer electrode structure of the electrodes 4 and 5 can be suppressed to prevent the increase in lag.

In accordance with the present invention, the material for the photoconductive layer 3 is not particularly limited to a specified one, provided that the photoconductive layer can be a thin layer which is applicable to ordinary photoconductive image pick-up tubes and which has a beam scanning surface that exhibits, in operation, a secondary electron emission yield $\delta$ of more than 1 (one). Taking into consideration the formation of the double-layer electrode structure of stripe-like or grid-like electrodes 4 and 5 on the photoconductive layer 3 as previously described, it is desirable that the material meet the formation process such as chemical etching or plasma etching. From this standpoint of view, the material has been studied and amorphous silicon containing hydrogen, fluorine or both was used as a material for the photoconductive layer to obtain good results in terms of characteristics and workability of the formation process.

The effects of the present invention are of course valid for a case wherein a stripe color filter for color encoding is combined with the image pick-up tube of this invention to constitute a single type color image pick-up tube.

As has been described, according to the present invention, the double-layer structure of the first and second stripe-like or grid-like electrodes is formed on the beam scanning surface to make the surface potential uniform during the beam scanning, thereby making it possible to prevent the degradation of resolution and increase in lag due to lateral flow of the signal electric charge and to obtain excellent imaging characteristics.

We claim:

1. An image pick-up tube of the type in which an electron beam is scanned on a photoelectric conversion target having a transparent substrate and a transparent electrode and a photoconductive layer formed on the transparent substrate, said tube comprising a first stripe-like or grid-like segmented electrode formed on a beam scanning surface of said photoconductive layer with its electrode segments electrically connected to each other, in insulating layer formed on said first electrode, and a second stripe-like or grid-like segmented electrode formed on said first electrode through said insulating layer with its electrode segments electrically connected to each other so that said second electrode is disposed farther away from said beam scanning surface of said photoconductive layer than said first electrode, said first and second electrode enabling elimination of spurious signals by preventing the redistribution of secondary electrons which may occur due to a potential gradient in said photoconductive layer.

2. An image pick-up tube according to claim 1 wherein said first electrode is formed on said photoconductive layer through an insulating layer.

3. An image pick-up tube according to claim 1, wherein said photoconductive layer is an amorphous semiconductor layer of silicon containing hydrogen.

4. An image pick-up tube according to claim 2, wherein said photoconductive layer is an amorphous semiconductor layer of silicon containing hydrogen.

5. An image pick-up tube according to claim 2, wherein said photoconductive layer is an amorphous semiconductor layer containing fluorine.

6. An image pick-up tube according to claim 3, wherein said photoconductive layer is an amorphous semiconductor layer containing fluorine.

7. An image pick-up tube according to claim 4, wherein said photoconductive layer is an amorphous semiconductor layer containing fluorine.

8. An image pick-up tube comprising:

a cathode for emitting a primary electron beam;

a target including a transparent conductive layer and a photoconductive layer formed on said transparent conductive layer, said photoconductive layer having a first surface on said transparent conductive layer onto which light is incident and a second surface with is scanned with the primary electron beam from said cathode, the first surface side of said photoconductive layer being biased with a positive voltage with respect to the second surface side of said photoconductive layer;

collector electrode means for collecting secondary electrons emitted by the scanning of said target with the primary electron beam from said cathode;

a first electrode of stripe-like or grid-like form formed on said second surface of said photoconductive layer;

an insulating layer formed on said first electrode;

a second electrode formed on said insulating layer; and said first electrode being at a potential substantially equal to that of said second surface of said photoconductive layer scanned with the primary electron beam and said second electrode being at a potential negative with respect to said collector electrode means, thereby preventing the redistribution of secondary electrons which may occur due to a potential gradient in said photoconductive layer and enabling elimination of spurious signals.

9. An image pick-up tube according to claim 8, wherein said first electrode is formed on said photoconductive layer through another insulating layer.

10. An image pick-up tube according to claim 8, wherein said photoconductive layer is an amorphous semiconductor layer of silicon containing hydrogen.

11. An image pick-up tube according to claim 9, wherein said photoconductive layer is an amorphous semiconductor layer of silicon containing hydrogen.

12. An image pick-up tube according to claim 9, wherein said photoconductive layer is an amorphous semiconductor layer containing fluorine.

13. An image pick-up tube according to claim 10, wherein said photoconductive layer is an amorphous semiconductor layer containing fluorine.

14. An image pick-tube according to claim 11, wherein said photoconductive layer is an amorphous semiconductor layer containing fluorine.

15. An image pick-up tube according to claim 8, wherein said second electrode has a stripe-like or grid-like form.

16. An image pick-up tube comprising:

a cathode for emitting a primary electron beam;

a target including a transparent conductive layer and a photoconductive layer formed on said transparent conductive layer, said photoconductive layer having a first surface on said transparent conductive layer onto which light is incident and a second surface which is scanned with the primary electron beam from said cathode, the first surface side of said photoconductive layer being biased with a positive voltage with respect to the second surface side of said photoconductive layer;

collector electrode means for collecting secondary electrons emitted by the scanning of said target with the primary electron beam from said cathode;

a first insulating layer of stripe-like or grid-like form partially embedded in said photoconductive layer and extending to said transparent conductive layer;

a first electrode of stripe-like or grid-like form formed on said first insulating layer;

a second insulating layer formed on said first electrode;

a second electrode formed on said second insulating layer; and said first electrode being at a potential substantially equal to that of said second surface of said photoconductive layer scanned with the primary electron beam and said second electrode being at a potential negative with respect to said collector electrode means, thereby preventing the redistibution of secondary electrons which may occur due to a potential gradient in said photoconductive layer and enabling elimination of spurious signals.

17. An image pick-up tube according to claim 16, wherein said photoconductive layer is an amorphous semiconductor layer of silicon containing hydrogen.

18. An image pick-tube according to claim 16, wherein said photoconductive layer is an amorphous semiconductor layer containing fluorine.

19. An image pick-up tube according to claim 16, wherein said second electrode has a stripe-like or grid-like form.

* * * * *